US007151902B2

(12) United States Patent
Rakov et al.

(10) Patent No.: US 7,151,902 B2
(45) Date of Patent: Dec. 19, 2006

(54) TONER TRANSFER TECHNIQUE

(75) Inventors: David M. Rakov, Rochester, NY (US); Graham S. Wright, Brockport, NY (US); Frank A. Shuster, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 145 days.

(21) Appl. No.: 11/042,935

(22) Filed: Jan. 25, 2005

(65) Prior Publication Data

US 2005/0244179 A1 Nov. 3, 2005

Related U.S. Application Data

(60) Provisional application No. 60/567,219, filed on Apr. 30, 2004.

(51) Int. Cl.
*G03G 15/16* (2006.01)
*G03G 15/00* (2006.01)

(52) U.S. Cl. ..... 399/66; 399/49

(58) Field of Classification Search ..... 399/66, 399/49, 299, 314

See application file for complete search history.

(56) References Cited

U.S. PATENT DOCUMENTS 5,659,843 A 8/1997 Takano et al. ..... 399/66
5,915,145 A 6/1999 Shimura et al. ..... 399/66
5,937,229 A 8/1999 Walgrove et al. ..... 399/66
5,983,044 A * 11/1999 Kodama et al. ..... 399/49
6,389,260 B1 5/2002 Kataoka et al. ..... 399/298
6,804,481 B1 * 10/2004 Mochizuki et al. ..... 399/66
7,072,597 B1 * 7/2006 Shimura et al. ..... 399/49
7,072,598 B1 * 7/2006 Takayanagi ..... 399/66
2002/0106210 A1 * 8/2002 Oki ..... 399/66
2003/0175040 A1 9/2003 Ogata et al. ..... 399/55

* cited by examiner

*Primary Examiner*—Andrew H. Hirshfeld
*Assistant Examiner*—Jeff Natalini
(74) *Attorney, Agent, or Firm*—Lawrence P. Kessler

(57) ABSTRACT

A module, included in an electrophotographic printer, for making toner images by a method in which transfer current for electrostatic transfer of toner images to receiver members is adjusted to compensate for ambient variations of toner charge-to-mass ratio (q/m). A predetermined functional relationship between transfer current and a control voltage parameter is utilized. Magnitudes of the control voltage parameter are derived from voltage measurements relating to creation of toner control patches on a photoconductive image-recording member included in a modular electrophotographic printer. Control voltage magnitude is linearly dependent on q/m. The functional relationship, which is characterized by three experimentally determined parameters, is co-optimized for providing efficient transfer of toner images and for minimizing back-transfer of toner away from a receiver member in a transfer station included in the module.

11 Claims, 7 Drawing Sheets

TONER TRANSFER TECHNIQUE

CROSS REFERENCE TO RELATED APPLICATION

Reference is made to and priority claimed from U.S. Provisional Application Ser. No. 60/567,219, filed on Apr. 30, 2004, entitled: TONER TRANSFER TECHNIQUE.

FIELD OF THE INVENTION

The invention relates to electrostatic transfer in an electrophotographic printer, and in particular to apparatus and method for constant-current transfer of toner images.

BACKGROUND OF THE INVENTION

In an electrophotographic modular printing machine of known type, such as for example a NexPress 2100 printer manufactured by NexPress Solutions, Inc., of Rochester, N.Y., color toner images are made sequentially in a plurality of tandemly arranged color imaging modules, and the toner images are successively electrostatically transferred to a receiver sheet adhered to a transport web moved through the modules. Commercial machines of this type typically employ intermediate transfer members in the respective modules, e.g., for the transfer to the receiver member of individual color separation toner images. In a transfer station included in each module of a NexPress 2100 printer, a current-controlled transfer mode is used to transfer a respective color toner image from a respective intermediate transfer roller to a receiver sheet.

In a modular machine of this type, sequential lay-downs of color separation toner images onto the receiver sheet generally give rise to a space charge within the stack of charged toner particles, and as the stack becomes thicker in successive modules the existence of correspondingly increased space charge requires increased transfer voltage, i.e., so that the electric field for toner transfer to the receiver member can be sufficient. When the current-controlled mode of transfer operates in a particular module with at least two previously transferred toner layers already stacked on the receiver member from prior modules, the inventors have noted that a mottle defect can occur in the previously deposited toner layer farthest away from the surface of the receiver member. Moreover, a certain amount of back-transfer of toner particles to the intermediate transfer member from this outermost previously deposited toner layer can also occur. The inventors believe that these phenomena are caused by electrical breakdown, such as air breakdown and/or other nonlinear high field effects such as, charge injection. The mottle defect and/or the back-transfer are particularly pronounced in relatively large areas of an image frame in which no toner is to be transferred in a particular module, in which areas one or more color toner images have already been transferred to the receiver member from the intermediate transfer roller.

As an example, when a receiver member has yellow and magenta toners transferred thereon (in the second and third modules of a machine which includes successive modules for black, yellow, magenta, and cyan) so as to make a final red color in a large solid area of an image frame, the back-transfer defect can occur when the receiver member moves through the module for cyan (in which module no cyan toner should be transferred within the red solid area). The current-controlled transfer mode demands that a predetermined transfer current flows in the cyan transfer station (the flow of transfer current is averaged over the entire image frame). When charged toner particles are transferred, their movement to the receiver member contributes to the transfer current. However, in relatively large areas in which no toner particles are to be transferred, e.g., in the red area of this example, breakdown currents tend to occur to transfer charge to such an area on the receiver member. Such breakdown currents can cause charge reversal of toner particles previously deposited on the receiver member, and in this example some of the magenta particles may have their charge reversed and thereby transfer back from the receiver member to the intermediate transfer member. The remaining magenta toner image on the receiver member may exhibit mottle as a result.

Under relatively lower field conditions, e.g., when too low a transfer current is used, another kind of back-transfer to the intermediate transfer member can occur such that toner which has been deposited on the receiver member in a particular module does not stay on the receiver member as the receiver member moves out of the contact zone between the intermediate transfer member and the receiver member. In the manner disclosed by the subject invention, this unwanted low-field back-transfer, can generally be eliminated by, increasing the transfer electric field.

In a transfer nip which includes an intermediate transfer roller and a receiver member adhered to a transport web (such as found in a NexPress 2100 printer) it is well known that breakdown phenomena can contribute to the imposed transfer current in three zones, i.e., pre-nip, in-nip, and post-nip. The inventors have noted that under certain high field transfer conditions, a cyclically recurring banding artifact may be observed within a transferred toner image, particularly when employing thick receiver members. The banding artifact is thought to be associated with buildup of net charge on the transport web, which net charge is relieved or neutralized periodically by intermittent post-nip ionizations.

There is well-known existing art whereby so-called image conditioning, has been used in attempts to increase transfer efficiency of a toner image and/or minimize transfer defects such as back-transfer or toner particles in background areas. Such image conditioning typically involves using one or more corona chargers to deposit surface charges on a toner image prior to electrostatic transfer to a receiver member. This type of image pre-conditioning has for example been disclosed in the Gundlach et al. patent (U.S. Pat. No. 3,984,182), the Nakahata patent (U.S. Pat. No. 4,402,591), and the Kuge et al. patent (U.S. Pat. No. 4,482,240).

The amount of space charge in a toner stack on a receiver member, and the associated propensity for back-transfer when depositing another toner image on the stack, depend directly on the charge carried by the toner particles. Moreover, the transfer voltage required to transfer the next toner image depends on this space charge, which transfer voltage typically increases for each successive toner image transferred. In order to achieve a maximum density level ($D_{max}$) in a toner image, a certain mass per unit area of toner must be transferred to a receiver member. Thus the charge-to-mass ratio (q/m) of the toner particles of each toner image is of key importance in determining transfer voltages and currents. It is common knowledge that the charge-to-mass ratio (q/m) of a typical developer, e.g., containing carrier particles and toner particles, can vary substantially from time to time. For example, q/m can fluctuate as the ambient relative humidity (RH) and temperature change, or can change as a result of carrier particle aging after prolonged usage.

The general problem of back-transfer can occur in a wide variety of apparatus, and is for example referred to in the Ohno patent (U.S. Pat. No. 4,888,621) and in the Kunishi patent (U.S. Pat. No. 4,992,831). In the Kataoka et al. patent (U.S. Pat. No. 6,383,704) it is disclosed that a specific surface treatment of toner particles can reduce back-transfer. In the Kataoka et al. patent (U.S. Pat. No. 6,389,260) it is disclosed that in multiple electrostatic transfers of toner images to create a toner stack on a receiver member, back-transfer is reduced if the transfer electric field is reduced for each successive toner image transferred to the stack. Another way to minimize back-transfer in multiple electrostatic transfers to a receiver member is described in the Hauser et al. patent (U.S. Pat. No. 4,093,457) and in the Matsumoto patent (U.S. Pat. No. 5,363,178), which patents disclose using toners such that each successive toner image, for transfer to an existing stack on the receiver member, has a lower charge-to-mass ratio (q/m) than the last previously deposited toner image.

Back-transfer is specifically dealt with in the Matsumoto patent (U.S. Pat. No. 5,041,877), which discloses apparatus, which is adapted to deal with variations in toner charge-to-mass ratio (q/m) caused by variations of ambient relative humidity and/or temperature. A receiver member is electrostatically adhered to and carried on a transport web through a series of transfer stations. In each of the transfer stations a toner image is transferred directly from a respective photoconductive imaging drum to the receiver member using corona transfer, i.e., by spraying corona ions, of polarity opposite to that of the toner image, from a respective corona charger to the back of the transport web. The surface potential is measured on each of the imaging drums, and from the results of these measurements the transfer current from the corresponding corona chargers are adjusted so as to provide suitable transfers in the successive transfer stations.

In an electrophotographic apparatus, the charge-to-mass ratio (q/m) of a toner image for transfer to a receiver member is hypothetically directly measurable, so that if q/m were to change the transfer voltage and current could be adjustable, e.g., via a process control algorithm dependent on prior experimentation. Such direct measurement of q/m is impractical. Typically, q/m is measured in off-line apparatus in which the toner particles in a sample mass of a developer are mechanically separated from carrier particles using electric and/or magnetic fields, whereupon the total charge of the separated toner particles is measured and the charge-to-mass ratio (q/m) thereby computed.

In the Walgrove et al. patent (U.S. Pat. No. 5,937,229), process control apparatus and method are disclosed in which changes of toner charge-to-mass ratio (q/m) are related to at least one process variable so as to control a constant-current power supply providing transfer current in a transfer station of a monochrome (black-and-white) electrophotographic machine. The electrophotographic machine includes a photoconductive imaging member from which toner images are transferred to receiver members sequentially moved through a transfer station. A process control system is employed, wherein a parameter related to charge-to-mass ratio (q/m) is measured and adjustments are made to a process control parameter or parameters related thereto, including process control parameters such as: pre-exposure surface potential ($V_0$) on the photoconductive imaging member, amount of photo exposure of the photoconductive imaging member, bias voltage in a toning station for development of latent images on the photoconductive imaging member, and grid voltage in a grid-controlled charger for charging the photoconductive imaging member to the pre-exposure surface potential. The adjustments to the process control parameters have relationship to controlled changes in transfer current so as to compensate for corresponding variations in q/m. A density patch is utilized in process of making these adjustments. In particular, the $V_0$ voltage required to create a predetermined $D_{max}$ in the density patch is measured. The required $V_0$ was demonstrated by Walgrove et al. to be a surrogate for q/m, inasmuch as the transfer current was shown experimentally to be linearly dependent on both the required $V_0$ and q/m.

Exemplary FIGS. 1A and 1B picture prior art electrophotographic printing apparatus in which certain relevant elements are schematically illustrated. FIG. 1A shows a simplified side elevational view of an electrophotographic color printer apparatus 100 inclusive of five tandemly arranged image-forming modules, indicated as M1, M2, M3, M4, and M5. Each of the modules generates single-color toner images for transfer to receiver members successively moved through the modules. Each receiver member can have transferred in registration thereto up to five single-color toner images. In a particular embodiment, M1 forms black toner images, M2 yellow toner images, M3 magenta toner images, and M4 cyan toner images. M5 can be used optionally to deposit a clear or colorless toner image, or alternatively to deposit a specialty color toner image such as for making proprietary logos or for expanding the color gamut of a resulting print. Receiver members are delivered from a supply (not shown) and transported through the modules. The receiver members are adhered (e.g., electrostatically via coupled corona chargers 124, 125) to an endless transport web 101 entrained and driven around rollers 102, 103. Each of the modules includes a photoconductive imaging roller, an intermediate transfer member roller, and a transfer backup roller. Thus in module M1, a black toner image can be created on photoconductive imaging roller 111 (PC1), transferred to intermediate transfer member 112 (ITM1), and transferred again to a receiver sheet moving through a transfer station, which transfer station includes ITM1 forming a pressure nip with a transfer backup roller 113 (TR1). Similarly, modules M2, M3, M4, and M5 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). A receiver member Rn, arriving from the supply, is shown passing over roller 102 for subsequent entry into the transfer station of the first module, M1, in which the preceding receiver member R(n−1) is shown. Similarly, receiver members R(n−2), R(n−3), R(n−4), and R(n−5) are shown moving respectively through the transfer stations of modules M2, M3, M4, and M5. An unfused print formed on receiver member R(n−6) is moving as shown toward a fuser for fusing the unfused print (fuser not shown). A power supply unit 105 provides individual transfer currents to the transfer backup rollers TR1, TR2, TR3, TR4, and TR5, respectively. In a location preferably between module M5 and roller 103, a densitometer array includes a transmission densitometer 104 (utilizing a light beam 110). As illustrated in more detail in connection with FIG. 1B, the densitometer array measures optical densities of five toner control patches transferred to an interframe area 109 located on web 101, such that one or more signals are transmitted from the densitometer array to a computer 120 with corresponding signals sent from the computer to power supply unit 105.

FIG. 1B shows top and side views of that portion of the apparatus of FIG. 1A, which includes transmission densitometer 104. The interframe area 109 and the aforementioned five-toner control patches transferred thereon are shown moving toward the aforementioned densitometer array, which includes densitometers 104, 105, 106, 107, and 108. The five-toner control patches are indicated as TCP1 (114), TCP2 (115), TCP3 (116), TCP4 (117), and TCP5 (118), which toner control patches are formed in modules M1, M2, M3, M4, and MS. Each of transmission densitometers 104, 105, 106, 107, and 108 is preferably provided with an individual light source, respectively providing beams of light such as beam 110 (light sources for densitometers 105, 106, 107, and 108 not shown). Interframe area 109 passes the densitometer array once every revolution of transport web 101, and the toner control patches TCP1, TCP2, TCP3, TCP4, and TCP5, which are created in timely fashion on the respective photoconductive imaging rollers PC1, PC2, PC3, PC4, and PC5, are transferred to the web in the interframe area as the interframe area moves successively through the modules M1, M2, M3, M4, and MS. Toner control patches TCP1, TCP2, TCP3, and TCP4, which are created in non-image areas on the respective photoconductive imaging rollers PC1, PC2, PC3, and PC4, typically have $D_{max}$ optical densities, i.e., are representative of the highest densities in toner images made in the respective modules. Maximum density toner control patches TCP5 can used for specialty color toners, or TCP5 can optionally not be created if clear or colorless toner is used in the fifth module M5. Optical transparency is an important characteristic for the transport web 101, i.e., so that the transmission densitometers 104, 105, 106, 107, and 108 can be employed. A cleaning station for cleaning web 101 is typically provided (cleaning station not illustrated). Alternatively, reflection densitometers can be used to measure the densities of the toner control patches, e.g., for a toner control patch made of a colorless toner. Signals are sent from densitometers 104, 105, 106, 107, and 108 to a computer 120, and corresponding signals are sent from the computer so as to activate power supply unit 105 and thereby provide appropriate transfer currents to the rollers TR1, TR2, TR3, TR4, and TR5. Moreover, signals are typically generated by computer 120 for controlling process parameters; upon which the individual densities of the toner control patches 114, 115, 116, 117, and 118 depend. In particular, such process control signals can be used to compensate for variations of charge-to-mass ratio (q/m) of the toners utilized in the modules, in as much as without such process control such variations of charge-to-mass ratio (q/m) would cause disadvantageous variations of toner densities in color prints produced by an apparatus such as apparatus 100.

There remains, however, a need to reduce transfer artifacts such as back-transfer and yet maintain optimal transfer efficiencies during transfer of toner images to a receiver member moved through the modules of a modular @rochester.rr.com electrophotographic machine. The subject invention relates to this need.

SUMMARY OF THE INVENTION

This invention relates to a module, included in a modular electrophotographic printer in which a plurality of toner-image-forming modules are in tandem arrangement, which module is for making toner images by a method in which transfer current for electrostatic transfer of the toner images to receiver members in a transfer station is adjusted so as to produce output image density substantially independent of the charge-to-mass ratio (q/m) of the toner particles used in the module. An object of the invention is to reduce or eliminate back-transfer during transfer of the toner images in the module, particularly if a receiver member moving through the module has been previously moved through two or more prior modules of the tandem arrangement (i.e., the receiver member can already be carrying two or more toner images successively transferred thereto in the prior modules). Another object of the invention is to maintain, as back-transfer is reduced, a useful, transfer efficiency.

In a preferred embodiment, ambient variations of charge-to-mass ratio (q/m) of the toner particles for making the toner images; are compensated by utilizing an experimentally determined functional relationship between transfer current and a control voltage parameter. Values of control voltage are derived from voltage measurements relating to creation of toner control patches on a photoconductive image-recording member included in the module. The control voltage parameter is linearly dependent on q/m. The functional relationship is co-optimized for providing efficient transfer of toner images to a receiver member and for minimizing back-transfer of toner away from the receiver member in the transfer station. According to the functional relationship between transfer current and control voltage, when the control voltage is less than or equal to a critical control voltage, the transfer current has an experimentally predetermined constant magnitude; and when the control voltage is greater than the critical control voltage, the transfer current has a linear increase as control voltage increases, which linear increase has an experimentally determined slope which is established so as to minimize back-transfer and to maintain a useful transfer efficiency. By means of a process control system, a toner control patch created on the photoconductive-image recording member is constrained to have a pr-selected maximum density as read by a densitometer. The process control system also controls certain process parameters so as to generate a control voltage having magnitude directly related to the pre-selected maximum density of the toner control patch.

In an alternative embodiment, if a control voltage is greater than the critical control voltage, an additional transfer current is added to a transfer current that would otherwise be determined according to the functional relationship of the previous embodiment, which additional transfer current is provided so as to reduce a certain banding artifact.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

Figure 1A:
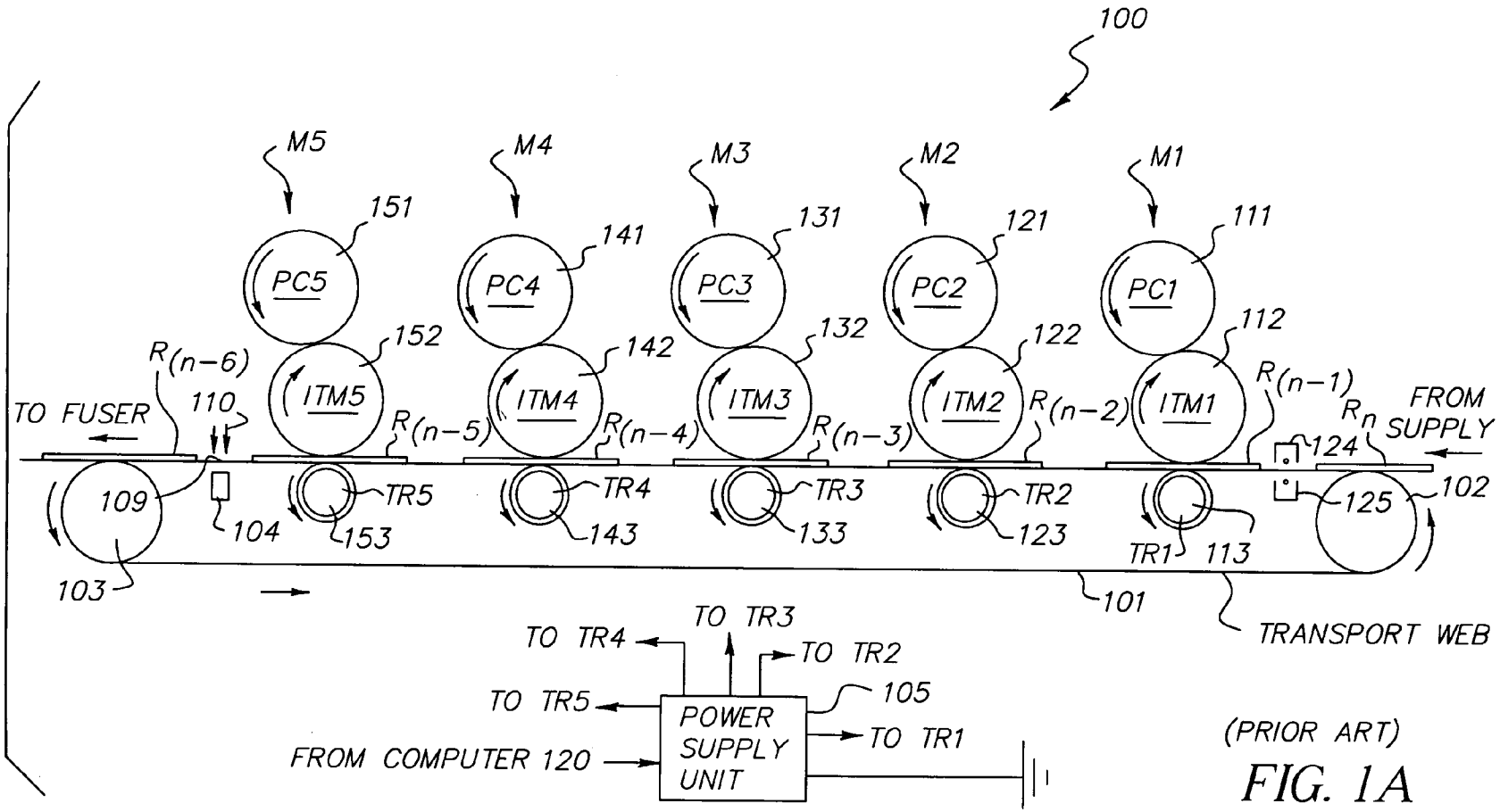
(PRIOR ART) FIG. 1A
FIG. 1A shows a side elevational view of an exemplary electrophotographic color printer apparatus inclusive of five tandemly arranged image-forming modules (prior art)

A module is disclosed for making toner images by a method in which transfer current for electrostatic transfer of the toner images to receiver members in a transfer station is adjusted so as to produce output image density substantially independent of the charge-to-mass ratio (q/m) of the toner particles used in the module. The module is preferably included in a modular electrophotographic printer, in which, a plurality of toner-image-forming modules are in tandem arrangement. In addition to compensating for changes in q/m, an object of the invention is to reduce or eliminate back-transfer during transfer of the toner images in the module, particularly if a receiver member moving through the module has been previously moved through two or more prior modules of the tandem arrangement (i.e., the receiver member can already be carrying two or more toner images successively transferred thereto in the prior modules).

Ambient variations of charge-to-mass ratio (q/m) of the toner particles for making the toner images in the module can be compensated according to the invention by utilizing an experimentally determined functional relationship between transfer current and a control voltage parameter. Values of control voltage are derived from voltage measurements relating to the creation at regular intervals of toner control patches on a photoconductive image-recording member included in the module. The control voltage is linearly dependent on q/m. According to the functional relationship, the transfer current is optimized so as to provide usefully efficient transfer of toner images to a receiver member and to minimize back-transfer of toner away from the receiver member in the transfer station. By means of a process control system, a toner control patch created on the photoconductive-image recording member is constrained to have a pre-selected maximum density as read by a densitometer. The process control system controls certain process parameters so as to generate, for any value of q/m of toner useful in the module, a control voltage having magnitude directly related to the pre-selected maximum density of the toner control patch.

In addition to use of the invention in a particular module, the invention can be used in any of the modules included in the tandem arrangement of modules. Thus, in relation to apparatus resembling apparatus 100 of FIG. 1, the magnitudes of transfer currents supplied to rollers such as rollers TR1, TR2, TR3, TR4, and TR5 (especially rollers TR3, TR4, and TR5) can be similarly dependent on voltage measurements relating to the creation of maximum density toner control patches, i.e., using a same type of control system and a similarly determined functional relationship for any of the modules which is operationally adapted for use according to the subject invention. Thus, the present invention can be advantageously used in a color printer to extend to more than one module the type of control system employed by Walgrove et al. in a monochrome apparatus (see U.S. Pat. No. 5,937,229). Moreover, the inventors have discovered that a specific form of functional relationship between transfer current and control voltage is especially useful, which functional relationship is characterized by, three experimentally determined parameters. Additionally, the values of these three experimentally determined parameters can differ from module to module, e.g., for each of the toners used in the modules.

Figure 2:
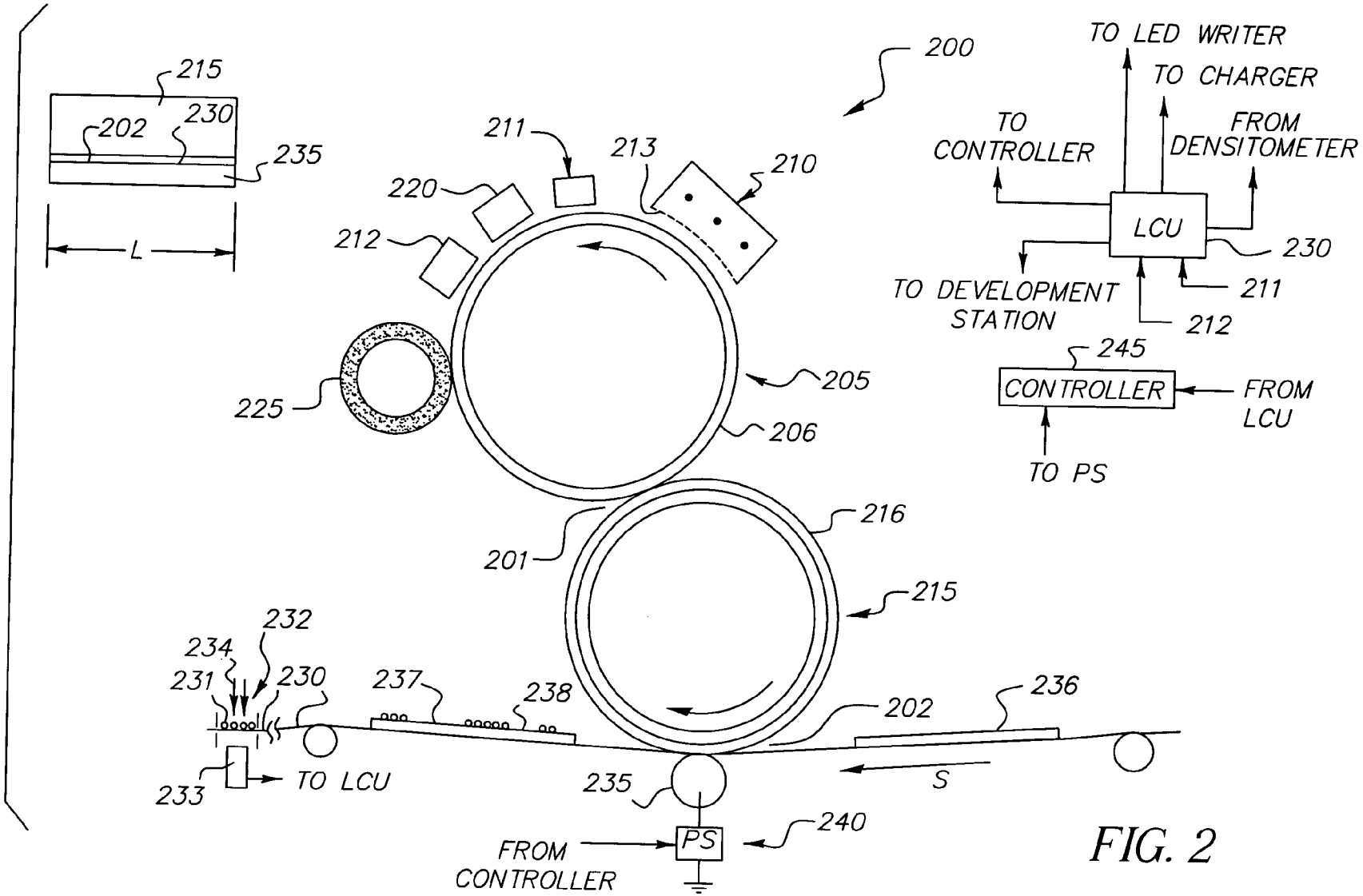
FIG. 2 shows a side elevational view and a reduced-size partial cross-track section of an exemplary module wherein the constant-current transfer technique of the invention can be employed.

FIG. 2 shows, in simplified side elevational view, certain elements of an exemplary module 200 wherein the constant-current transfer technique of the invention can be employed. Module 200 is representative of any module included in a plurality of tandemly arranged modules incorporated in modular electrophotographic reproduction apparatus. In a preferred embodiment, module 200 includes a photoconductive image-recording member in the form of imaging cylinder 205, an intermediate transfer member in the form of blanket cylinder 215, and a transfer roller 235 forming a transfer nip 202 with blanket cylinder 215. Captured in nip 202 is a transport web 230 shown moving from right to left at speed, S, as indicated by an arrow. A receiver member 236, adhered preferably electrostically to transport web 230, is shown moving towards transfer nip 202 wherein a toner image created on surface 206 of imaging cylinder 205 can be transferred from surface 216 of the blanket cylinder 215 to the receiver member, the toner image having previously been transferred from the imaging cylinder to the blanket cylinder in transfer nip 201.

Also shown in FIG. 2 is a partial section of module 200 which is cross-track to the direction of motion of the transport web 230, showing the transfer nip 202 having a length, L.

For sake of simplicity, receiver member 236 is shown as an untoned sheet, inasmuch as module 200 can be incorporated in manner similar to that of module M1 in the electrophotographic color printer apparatus 100. It is however to be understood that module 200 can be incorporated in manner similar to that of any of the modules of apparatus 100, in particular one of modules M3, M4, or M5 wherein back-transfer is more likely to occur as explained above. Thus a toner image 237 formed in module 200 and transferred to a receiver sheet 238 can rest atop toner previously transferred thereto in one or more modules (toner transferred previously not shown).

Disposed about photoconductive image-recording member 205 are: a charging device 210 for charging surface 206 to a uniform surface potential, e.g., a gridded corona charger as shown; a voltmeter such as an electrostatic voltmeter 211 for measuring voltage magnitude of the uniform surface potential produced by charging device 210; an exposure device 220 to modulate the uniform surface potential and thereby form a latent image on the photoconductive image-recording member, e.g., a LED writer as shown; and, a development station 225 to develop the latent image so as to form a toner image on the surface of the imaging cylinder. Preferably, development station 225 includes a magnetic brush. Located between the exposure device 220 and the development station 225 is a voltmeter 212 for measuring a post-exposure surface potential within a patch area of a patch latent image formed from time to time in a non-image area on surface 206. The patch latent image is developed in the development station so as to produce a maximum-density toner patch thereon. The maximum-density toner patch is transferred from the photoconductive image-recording member 205 to the intermediate transfer member 215 and from thence to an interframe area on the transport web 230, as described more fully below.

Photoconductive image-recording member 205 can alternatively have the form of an endless web (not illustrated). Intermediate transfer member 215 is preferably a compliant roller of well-known type, as illustrated. However, in an alternative embodiment intermediate transfer member 215 can have the form of a rotatable web supported by an auxiliary roller, such that this auxiliary roller forms, with a roller similar to transfer roller 235, a transfer nip akin to nip 202 so as to capture both the rotatable web and a transport web such as web 230 (rotatable web and auxiliary roller not illustrated).

Charging device 210 can be any suitable device for producing uniform pre-exposure potential on photoconductive image-recording member 205, the charging device including any type of corona charger or a roller charger.

In another alternative embodiment of a module for use in the invention, the module does not include an intermediate transfer member and toner images formed on a photoconductive image-recording member such as a photoconductive roller are transferred directly to receiver members carried on a transport web and moved through a transfer nip formed by the photoconductive image-recording member and a transfer roller. Hence for transfer to receiver members in a transfer station of this alternative embodiment, the transfer station includes the photoconductive image-recording member and the transfer roller (in lieu of the intermediate transfer member 205 and the transfer roller 235 of preferred embodiment 200).

A constant-current power supply (PS) 240, delivers transfer current to transfer roller 235 for transferring toner images to receiver members in transfer nip 202. To supply a certain transfer current in nip 202, PS 240 imposes a corresponding transfer voltage between the intermediate transfer member 215 and the transfer roller 235.

Transport web 230 is a preferably a rotatable, endless, transparent, dielectric, driven belt, preferably similar to web 101 of apparatus 100. The speed, S, of web 230 is commonly referred to as the process speed. Located on web 230 is an interframe area 232 akin to interframe area 109 of apparatus 100. Interframe area 232 is shown moving past a transmission densitometer probe 233 located downstream of module 200, with the interframe area carrying thereon a toner control patch 231. The toner control patch 231 had been originally created as a maximum-density toner patch on surface 206 of imaging cylinder 205, transferred to blanket cylinder 215, and then transferred from thence to the interframe area and moved over probe 233 where the optical density of the toner control patch is measured using light beam 234. Alternatively, in lieu of densitometer 233, a reflection densitometer can be used.

Associated with module 200 are, a logic and control unit (LCU) 230 and a controller 245. LCU 230 receives input signals from the densitometer 225 and the voltmeters 211, 212. LCU also sends control signals to the charger 210, the LED writer 220, and the development station 225. These control signals are for controlling, e.g. via a control algorithm stored within LCU 230, at least one of: the voltage magnitude of the uniform potential produced by charging device 210, the amount of photoexposure from the LED writer 220 for forming a patch latent image on surface 206, and a bias voltage applied to the developer station for development of the latent patch image so as to form a maximum-density toner patch on surface 206.

In order to clarify the roles of LCU 230 and controller 245, reference is first made to FIGS. 3A–3D, which relates to voltage levels defining a patch latent image as well as voltage levels for development of the patch latent image by developer station 225 so as to form a maximum-density toner patch on surface 206. (Voltage magnitudes are used in FIGS. 3A–3D so that the discussion can relate to either negative or positive charging of photoconductive image-recording member 205).

Figure 3A:
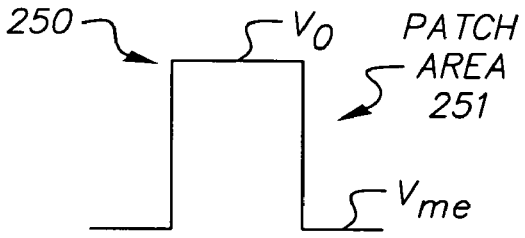
FIG. 3A is a plot showing voltage levels of a patch latent image for charged area development (CAD)

FIG. 3A is a plot showing voltage levels of a patch latent image 250 to be developed by charged area development (CAD). In FIG. 3A, surface potential is indicated as a function of distance along a line passing through a patch area 251. The patch area has voltage magnitude equal to a pre-exposure potential, $V_0$, while the area surrounding the patch area is discharged to a potential $V_{me}$. The potential $V_{me}$ is created by a maximum exposure as provided by exposure device 220 in formation of not only the patch latent image 250 but also in formation of a latent image of an image frame. A minimum value of $V_{me}$ can for example be produced during the available time in which a pixel area can be exposed by one of the LED emitters included in the LED writer 220. $V_{me}$ has a potential greater than the so-called toe potential, which is produced by very long photo exposures.

Figure 3B:
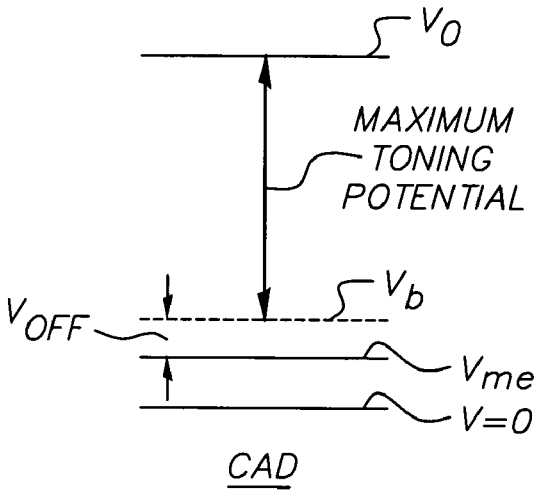
FIG. 3B is an illustration showing voltage levels for development of the patch latent image of FIG. 3A.

FIG. 3B is an illustration showing voltage levels for development of the patch latent image of FIG. 3A. A maximum toning potential is indicated which is the difference between $V_0$ and a bias voltage, $V_b$, which bias voltage, is applied to the magnetic brush of development station 225. The following relations hold for CAD development:

$$\text{Maximum Toning Potential}=(V_0-V_b)=(V_0-V_{me}-V_{off})$$

$$\text{Offset Potential}=V_{off}=(V_b-V_{me})$$

The offset potential determines the magnitude of the bias potential in relation to the maximum exposure potential, $V_{me}$.

Figure 3C:
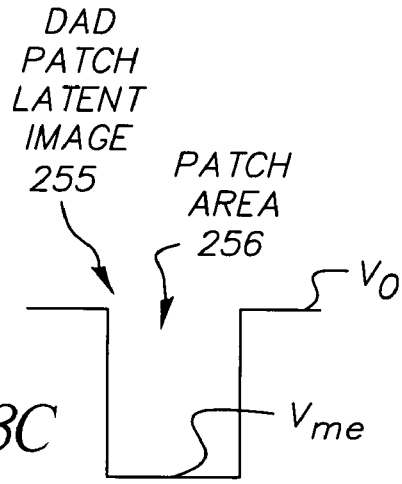
FIG. 3C is a plot showing voltage levels of a patch latent image for discharged area development (DAD)

FIG. 3C is a plot, showing voltage levels of a patch latent image 255 to be developed by discharged area development (DAD). A patch area 256 is discharged to a potential $V_{me}$, while the area surrounding the patch area has voltage magnitude equal to the pre-exposure potential, $V_0$. The potential $V_{me}$ is produced as described for FIG. 3A.

Figure 3D:
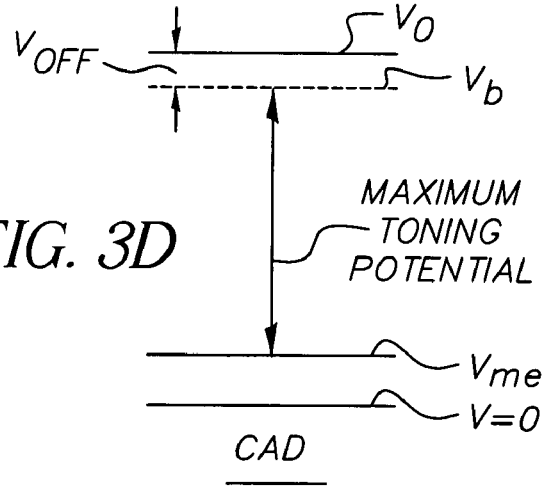
FIG. 3D is an illustration showing voltage levels for development of the patch latent image of FIG. 3C.

FIG. 3D is an illustration showing voltage levels for development of the patch latent image of FIG. 3C. The maximum toning potential is indicated which is the difference between the bias voltage, $V_b$, and $V_0$. The following relations hold for DAD development:

$$\text{Maximum Toning Potential}=(V_b-V_{me})=(V_0-V_{me}-V_{off})$$

$$\text{Offset Potential}=V_{off}=(V_0-V_b)$$

The offset potential determines the magnitude of the bias potential in relation to $V_0$. From the above description it may readily be seen that the relations for the maximum toning potential have the same form for both CAD and DAD, namely, the maximum toning potential=$(V_0-V_{me}-V_{off})$.

Figure 1B:
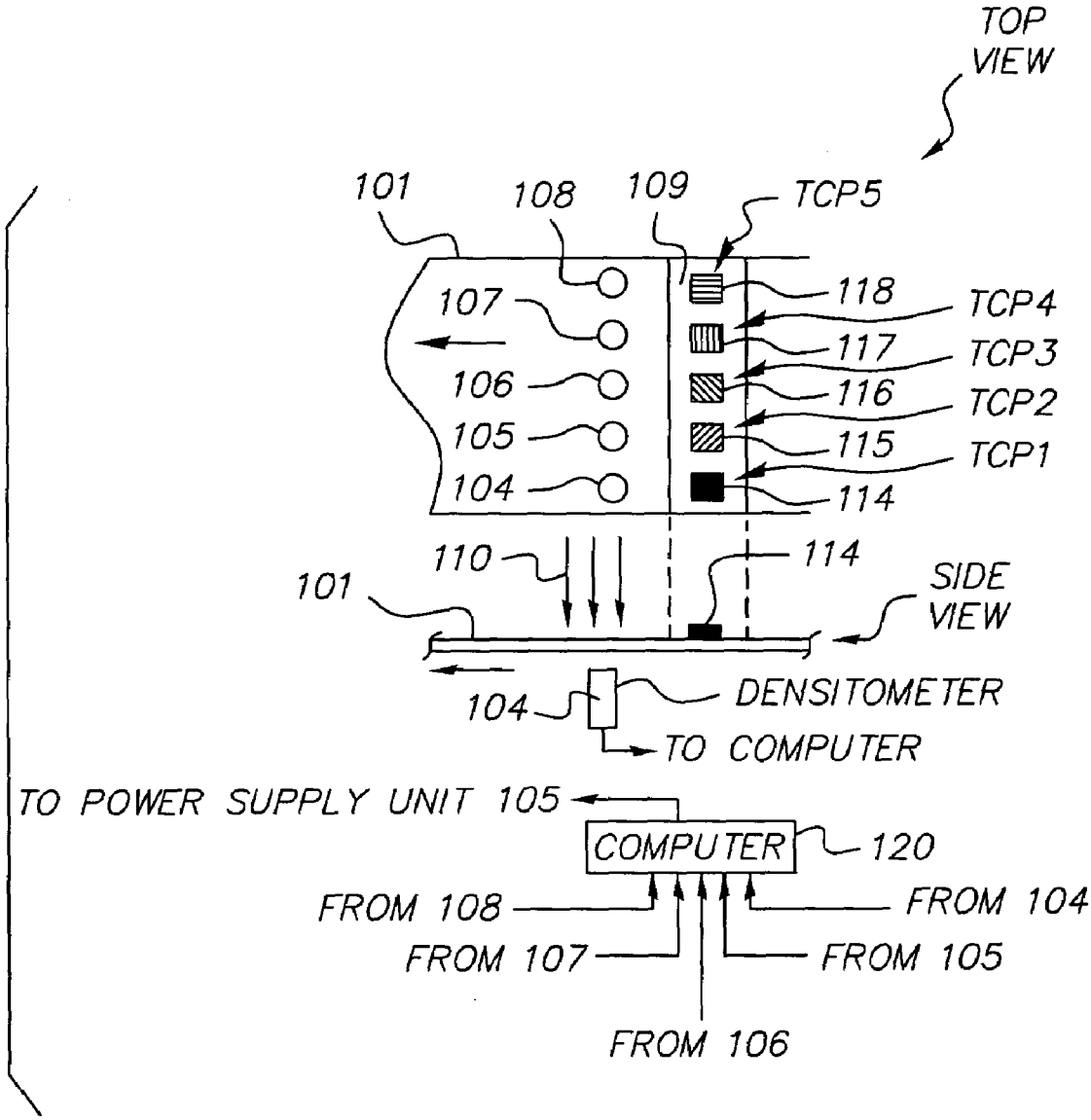
(PRIOR ART) FIG. 1B
FIG. 1B shows top and side views of a portion of the apparatus of FIG. 1A (prior art)

In apparatus, such as that of FIG. 1A, offset potential $V_{off}$ typically has a magnitude between about 70 volts and 100 volts, and $V_0$ typically ranges between about 300 volts and 700 volts.

Returning to FIG. 2, and in reference to formation of a toner control patch 231, a voltage magnitude $V_0$ as measured by voltmeter 211 provides an input signal to LCU 230. Similarly, a voltage magnitude $V_{me}$ as measured by voltmeter 212 provides an input signal to LCU 230, which relates to formation of the patch latent image on surface 206 (FIGS. 3A and 3C). After development of the patch latent image, the resulting maximum-density toner patch is twice-transferred (from imaging cylinder 205 to transport web 230) and the optical density of the resulting toner control patch 231 is measured by densitometer 233, and a density signal thereby sent to LCU 230.

In the process control system of the invention, one or more process control signals can be generated by LCU 230 so as to produce an optical density of toner control patch 231 that is substantially equal to a pre-selected density. For example, LCU 230 can adjust the voltage magnitude of $V_0$ by sending a process control signal to the charging device 210, e.g., which process control signal can for example change the voltage of the grid 213 of charger 210. Alternatively, a process control signal can be sent from LCU 230 to exposure device 220 so as to alter the exposure for producing the voltage $V_{me}$ for the patch latent image. Moreover, a process control signal can be sent from LCU 230 so as to alter the bias voltage $V_b$ applied to the magnetic brush of developer station 225 and thereby control the amount of toner in the maximum-density toner patch formed from the patch latent image. The process control system adjusts any of such process control signals so that the density of the toner control patch 231 substantially matches the pre-selected density. Preferably, the pre-selected density is a reference maximum density. The value of the reference maximum density can for example be stored within LCU 230.

At a time when the process control system confirms that the optical density of toner control patch 231 substantially matches the reference maximum density, e.g., within LCU 230, a signal is sent from LCU 230 to a controller 245. The controller 245 controls transfer current in transfer nip 202. An output signal sent from controller 245 determines the transfer current provided by the power supply 240. An adjustment to the transfer current can thus be made for transferring toner images to a certain number of incoming receiver members, including receiver member 236 (incoming receiver members can carry toner images transferred thereto in prior modules, as described above). The interframe area 232 is moved past probe 233 just once for each revolution of the endless transport web 230, and so a certain number, say n, of receiver members pass through transfer nip 202 for each such revolution. Hence it is sufficient that a maximum-density toner patch be made on member 205 periodically, e.g., once for each batch of n receiver members, or less frequently as may be necessary, e.g., depending on the length of a print run. The transfer current is preferably adjusted via controller 245 with a same periodicity.

LCU 230 and controller 245, which are shown as separate entities, can alternatively be included in one unit.

A key feature of the subject invention is the way that transfer current is controlled and adjusted, so as to compensate for fluctuations or variations of charge-to-mass ratio (q/m) of the toner particles used in development station 225. A magnitude of control voltage parameter, for producing a transfer current in accordance with a preferred functional relationship therebetween, is derived from the voltage magnitude produced by the charging device 210 on surface 206 of the photoconductive image-recording member 205. This voltage magnitude (controllable by the process control system) is a determinant for producing the maximum toning potential which ultimately results in toner control patch 232 having density substantially equal to the reference maximum density.

Figure 4:
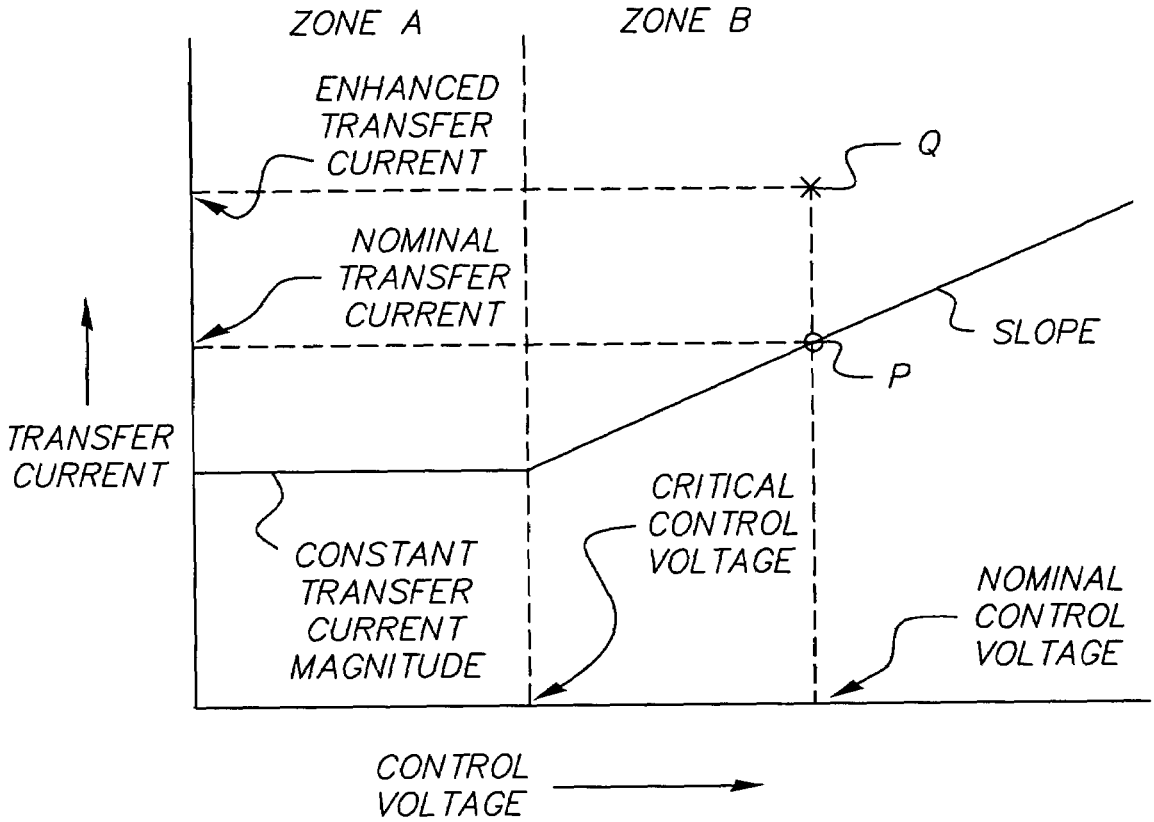
FIG. 4 schematically illustrates a generalized functional relationship in which transfer current is determined by a control voltage parameter.

FIG. 4 schematically illustrates the preferred functional relationship in generalized form, in which functional relationship transfer current is plotted as a function of control voltage (solid line). In accordance with this functional relationship, the transfer current has an experimentally predetermined constant magnitude when magnitude of the control voltage parameter is less than or equal to a critical control voltage magnitude (Zone A, left of the dashed line of FIG. 4). On the other hand, when magnitude of the control voltage parameter is greater than the critical control voltage magnitude, the transfer current has a linear increase of magnitude with increase of control voltage, which linear increase is characterized by an experimentally predetermined slope (Zone B).

The control voltage parameter is derived from the voltage magnitude, $V_0$, of the uniform potential established on the photoconductive image-recording member by the process control system described above in relation to FIG. 2. The control voltage parameter is preferably defined in one of two modes:

Mode (1) Control voltage parameter=$V_0$

Mode (2) Control voltage parameter=Maximum Toning Potential=$(V_0-V_{me}-V_{off})$ Each of these modes is applicable to both the CAD and DAD modes of development (described above in relation to FIG. 3). It is more preferred to use mode (2), because the maximum toning potential is generally a more accurate gauge of how much toner charge is developed and therefore how large a transfer current is required to move toner from the intermediate transfer member to the receiver member.

In general, control voltage magnitude increases as charge-to-mass ratio (q/m) of the toner increases, and thus in Zone B the transfer current increases as control voltage magnitude increases. For control voltage magnitudes above the critical control voltage magnitude, and in particular if at least two toner images are already on a receiver member to which transfer of another toner image is being carried out, there is a propensity for occurrence of the back-transfer artifact described above if the transfer current is set to be greater than that defined by the sloping line. This is because the transfer voltage and the associated transfer electric fields tend to be very high for transfer currents above this line, so that high-field breakdown effects can occur. On the other hand, if the transfer current is set below the sloping line in Zone B, transfer efficiency tends to be compromised. Moreover, if the transfer current is set below the sloping line, another type of back-transfer image defect can occur (sometimes referred to as "bird-track defects") even if there is no priorly transferred toner image on the receiver member. The preferred sloping line thus provides the lowest practical values of transfer current so as to minimize both types of back-transfer while maintaining useful transfer efficiency, and the slope of this line is experimentally established for different values of control voltage magnitude above the critical control voltage magnitude.

The critical control voltage magnitude is experimentally determined as being the control voltage magnitude below which back transfer is not observed. The magnitude of the constant transfer current in Zone A is determined by the magnitude of the current in zone B as measured for the critical control voltage magnitude. The value of the critical control voltage magnitude itself is preferably less than or equal to the control voltage magnitude at which onset of back-transfer can occur.

The implementation of a constant magnitude of transfer current in Zone A according to the invention is advantageous because q/m values decline as control voltage declines below the critical control voltage. As a result, surface adhesive forces, especially between toner particles and an intermediate transfer member, become much more important as affecting the transfer efficiency. For example, it has been found that an electric field of about 20 volts/micrometer is required to overcome adhesive forces. By keeping the transfer current magnitude constant in Zone A of the functional relationship, the resulting higher electric fields for lower q/m values assure that toner transfer remains efficient.

Referring again to FIG. 4, a nominal control voltage magnitude corresponding to the point labeled P is indicated for which a nominal transfer current would be supplied according to the sloping line of the functional relationship in Zone B. For this nominal condition, the charge-to-mass ratio (q/m) of the toner can be high enough to cause a sporadic back-transfer artifact, or a back-transfer artifact, which is very nonuniform. The inventors have found that for control voltage magnitudes greater than that for onset of back-transfer, it can be advantageous to use an enhanced transfer current, corresponding to the point labeled Q. Such an enhanced transfer current actually induces back-transfer so that the back-transfer is relatively uniform, but at the expense of a certain amount of mottle in the back-transfer area of an image frame. The enhanced transfer current for point Q, in relation to that for point P, can be experimentally established for a given module and type of receiver member. An operator of a machine can thus override the automatic strategy determined by the functional relationship of FIG. 4, e.g., by inputting an enhanced transfer current. The present invention contemplates experimental establishment of an additional functional relation for Zone B for purpose of optimally inducing back-transfer whilst minimizing any attendant mottle, which additional functional relation would include a point such as Q.

Values of the three experimentally predetermined parameters for FIG. 4, i.e., the constant transfer current magnitude in Zone A, the critical control voltage magnitude dividing Zones A and B, and the slope in Zone B, are preferably determined in each of the modules for which the invention is utilized, e.g., module 200 of FIG. 2. This can be done within a given module by using within the development station several developers in which the toner particles have differing charge-to-mass ratios (q/m), and then measuring the respective voltage magnitudes required to produce, via the process control system, the respective desired maximum densities in the respective toner control patches on the transport web.

For a given module, the values of the three experimentally determined parameters have been found to depend on various factors, such as for example: process speed, nip length, type and/or composition of receiver members, and thicknesses of receiver members. Moreover, certain physical properties can affect these parameters, such as adhesive forces of toners, surface conductivity of toners, charge injection from surfaces, and the like. Thus the values of the three experimentally determined parameters can differ from module to module, i.e., these parameters are preferably tailored for each module separately. Moreover, adjustments to these parameter values may be required when differing receiver members are used from print run to print run. The corresponding parameter values can be stored in a lookup table, for example in a lookup table stored within a logic-and-control unit such as LCU 230 of FIG. 2, or in a computer associated with the modules.

Any transfer current, which is determined for the transfer nip 202 of module 200 in accordance with the invention, can be scaled so as to take into account any process speed S' and any nip length L'. Thus any transfer current $I_T$ as determined for a nip length L and a process speed S (see FIG. 2) can be replaced by a modified transfer current $I_T'$ according to the following scaling equation:

$$I_T'=(I_T)(S'/S)(L'/L)$$

In the above scaling equation, $I_T$ is any transfer current utilized for nip length L and process speed S as determined from a control voltage according to the functional relationship depicted in FIG. 4, i.e., for a particular type and/or thickness of the transport web, receiver member type, toner composition, toner size, and so forth.

EXAMPLE 1

Relation Between Magnitude of Pre-exposure Surface Potential and Charge-to-mass Ratio (q/m)

Figure 5:
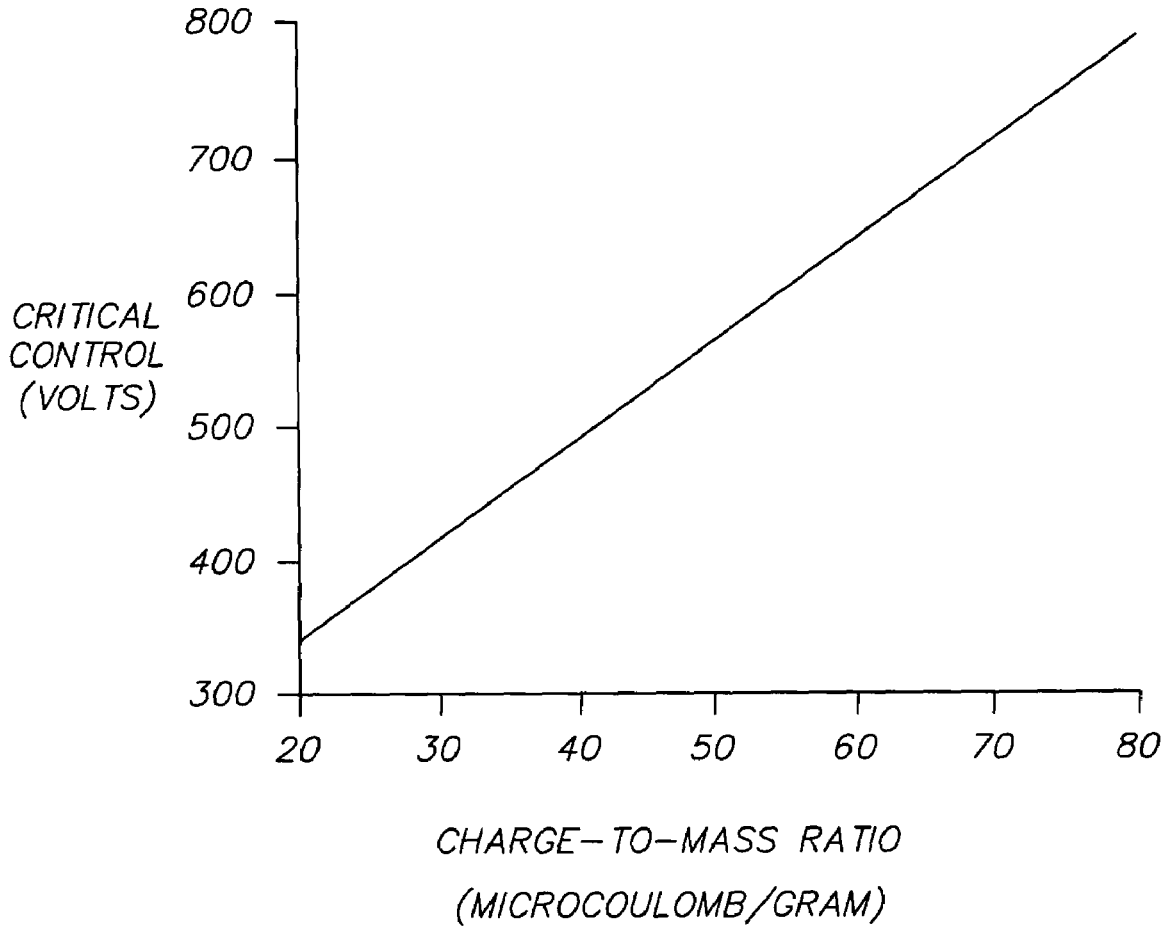
FIG. 5 relates to a module for practicing the invention and shows an exemplary experimentally determined linear relation between magnitude of pre-exposure surface potential on a photoconductive image-recording member and charge-to-mass ratio (q/m) of toner particles used in the module.

FIG. 5 relates to a module similar to the module of FIG. 2, and shows an exemplary experimentally determined linear relation between magnitude of pre-exposure surface potential measured on the photoconductive image-recording roller and charge-to-mass ratio (q/m) of toner particles used in the development station of the module. The magnitudes of pre-exposure surface potential, $V_0$, were established using a process control system similar to that described for embodiment 200, i.e., in which a toner control patch was formed on a transport web. The toner control patch was formed for different developers for which the q/m was measured off-line. The process control system caused adjustments of operational control parameters for establishing the $V_0$ magnitudes such that a same maximum optical density of the toner control patch was produced for each q/m value tested.

The photoconductive image-recording roller was of negatively charging type, the toner particles were negatively charged, and DAD development of the patch latent images was carried out. Three different developers were employed in the tests. The developers included ferrite-type carrier particles, surface-treated toner particles having a volume-averaged particle diameter of about 8 micrometers, with toner concentrations typically about 6% by weight. A developer was loaded into the development station and the machine including the module was started up and run until fully operational, using the process control system. The resulting value of $V_0$ was recorded and the machine stopped, whereupon a sample of the developer was removed from the development station and the q/m of the toner was obtained off-line in well-known fashion (i.e., after separating the toner from the carrier particles, measuring total charge on these toner particles, and weighing them). This procedure was repeated a number of times using the same developer. Then the other developers were tested in the same fashion. The toners from the three different developers were found to have q/m values clustering around about 40, 50 and 70 microcoulombs/gram. The corresponding values of $V_0$ measured as described above were used to obtain the graph of FIG. 5, which shows a linear regression line for the observed data.

Example 1 demonstrates that for a module included in an electrophotographic color-printing machine, a linear relationship can describe the dependence of $V_0$ on charge-to-mass ratio (q/m) when a process control system is used as described above. Moreover, in view of the demonstrated linear dependence shown in FIG. 5, values of $V_0$ can be considered as surrogates for the corresponding values of q/m.

EXAMPLE 2

Experimentally-determined Values of Parameters Relating to FIG. 4

Figure 6:
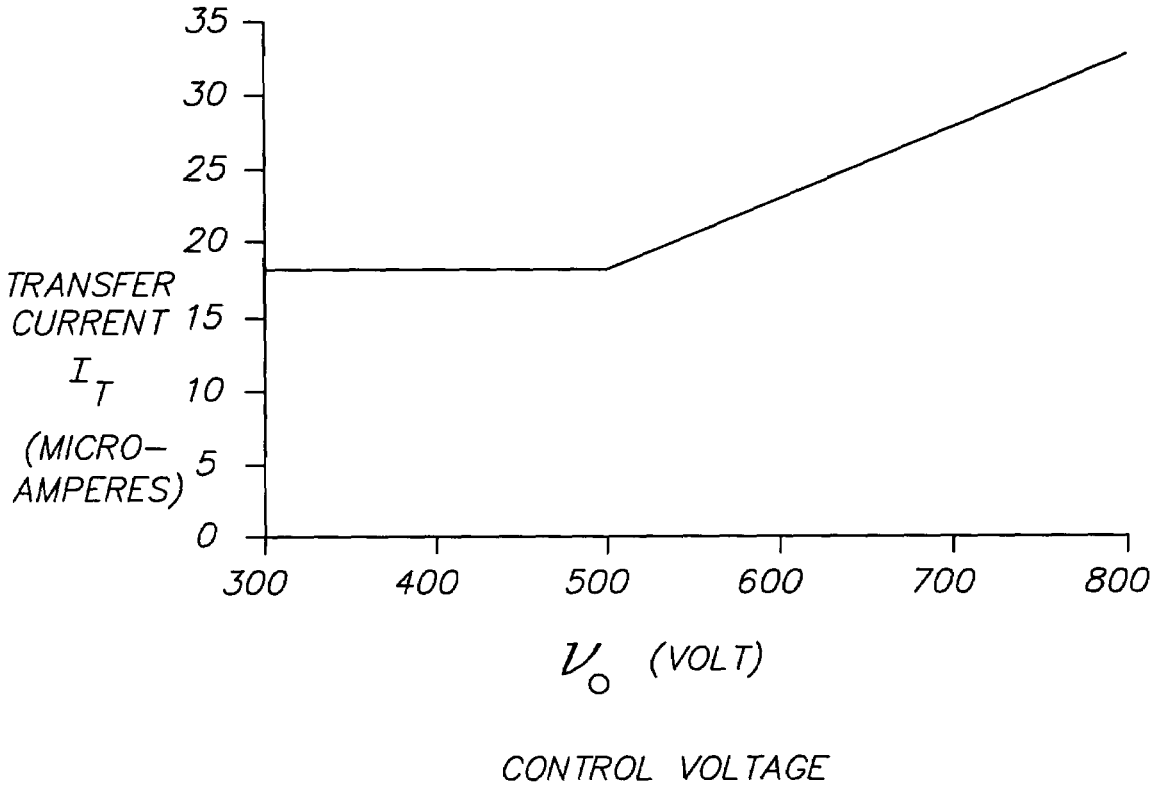
FIG. 6 shows an experimentally determined graph relating to FIG. 4, in which, graph magnitude of the control voltage parameter is equal to magnitude of pre-exposure surface potential on the photoconductive image-recording member included in the module, which provided the data plotted in FIG. 5.

Experiments were carried out to measure values of the three parameters defining the functional relationship of FIG. 4, namely, the minimum practical constant transfer current magnitude in Zone A, the critical control voltage dividing Zones A and B, and the minimum practical slope in zone B. The results are shown in FIG. 6. The same module and similar developers were used as for Example 1. A process speed S of 300 mm/sec and a nip length L of 360 mm were used. The intermediate transfer roller had a doped polyurethane blanket coated with a thin ceramer layer.

In FIG. 6, control voltage parameter magnitude is magnitude of $V_0$, ranging between 300 volts and 800 volts. The critical control voltage magnitude is 500 volts. Thus below 500 volts, a constant transfer current of about 18 microamperes is used. Above 500 volts, the slope of the experimentally determined line is 0.050 microampere/volt.

It may be noted that had the control voltage parameter not been $V_0$ but instead the maximum toning potential ($V_0-V_{me}-V_{off}$), the above-determined constant transfer current of about 18 microamperes below the critical control voltage magnitude would be the same. Furthermore, the slope of 0.050 microampere/volt would remain unaffected providing that $V_{me}$ and $V_{off}$ were constant throughout the tests. In fact, $V_{off}$ had a magnitude of about 85 volts throughout, whilst $V_{me}$ had relatively small variations, and therefore in this particular instance the corresponding results using ($V_0-V_{me}-V_{off}$) were not significantly different. However, during machine operation this might not be the case, e.g., from print run to print run.

Referring again to FIG. 5, it may be seen that there is a critical q/m of about 42 microC/g, which corresponds to the critical control voltage of 500 volts in FIG. 6. Moreover, it was observed by the inventors that the threshold for back-transfer occurred for a $V_0$ magnitude between 500 volts and about 600 volts. Thus it is preferred that toner particles for use in the modules have q/m of less than about 55 microC/g.

The automatic control strategy for determining optimal transfer current according to the functional relationship of FIG. 4 has particular pertinence for toner transfer in a 5-module color electrophotographic printing machine. As was discussed in relation to FIG. 1A, such a machine can have the first four modules for sequentially forming black, yellow, magenta, and cyan toner images, respectively. Because the automatic control strategy for a given module is particularly important when two or more toner images are already present on a receiver member entering this module, it will be evident that the invention improves the accurate reproduction of certain colors, which are restricted to local areas in an image frame. Thus for example, in local bichrome areas which are designated to be red (yellow plus magenta), green (yellow plus cyan), or blue (magenta plus cyan), the invention helps to prevent deleterious back-transfer of magenta particles from red areas, or cyan particles from green or blue areas.

Moreover the fifth module of a 5-module machine, which transfers the last toner image to the stack on the receiver member, can be used to deposit a gamut-expanding toner such as a specialty toner, such as a red, green, or blue toner, or alternatively a color toner for enhancing black areas. Transfer in the fifth module using such toners therefore can entail as many as four previously transferred toner images, thus making the invention especially useful for this module.

Alternatively, a clear or colorless toner can be used in the fifth module, either image-wise or as a uniform layer over an entire image frame. If a uniform layer of clear toner is to be deposited by the fifth module, lower transfer currents can advantageously be used, inasmuch as such a layer can include a certain degree of mottle or even incomplete transfer without compromising a resulting print. As a result, when depositing clear toner, e.g., in a fifth module, it is preferable to reduce the constant magnitude of the transfer current corresponding to Zone A of FIG. 4 as compared to the other modules, and it is similarly preferable that the slope of the line corresponding to Zone B is reduced so as to suitably reduce the transfer current and thereby minimize back-transfer while maintaining a useful transfer efficiency for the clear toner.

In summary, the subject invention provides a method of transferring a toner image to a receiver member in a transfer station of a module included in a plurality of modules tandemly arranged in an electrophotographic printer. The module further includes a photoconductive image-recording member, a charging device, an exposure device, and a development station. Associated with the module is a process control system and a controller. The transfer station includes a transfer roller and a constant-current power supply for delivering a transfer current. The method includes the steps of: establishing on the photoconductive image-recording member, via the charging device, a uniform surface potential having a voltage magnitude adjustable via the process control system; modulating the uniform surface potential with the exposure device and thereby forming a latent image; developing, in the development station, the latent image and thereby forming the toner image on the photoconductive image-recording member; moving a receiver member through the transfer station and electrostatically transferring the toner image to the receiver member, the transfer current controlled by the controller according to a functional relationship between transfer current and a control voltage parameter. A control voltage magnitude is derived from the voltage magnitude adjustable via the process control system. In the step of electrostatically transferring the toner image to the receiver member according to the functional relationship, if the control voltage magnitude is less than or equal to a critical control voltage magnitude the transfer current has a predetermined constant magnitude, and if the control voltage is greater than the critical control voltage the transfer current has a linear increase of magnitude with increase of control voltage magnitude, which linear increase is characterized by a predetermined slope. As part of the process control system, a toner control patch is made from time to time that has a measured optical density substantially equal to a reference maximum density. The toner control patch is derived from a patch latent image formed on the photoconductive image-recording member by the charging device and the exposure device, the photoconductive image-recording member having been charged by the charging device to the voltage magnitude adjustable via the process control system prior to creating the patch latent image. The patch latent image is developed by the development station, and the reference optical density, substantially equal to the reference maximum density, is obtained by causing the process control system to control operating parameters for at least one of the charging device, the exposure device, and the development station. In the step of electrostatically transferring the toner image to the receiver member when control voltage magnitude is greater than the critical control voltage magnitude, the transfer current preferably has a lowest practical value so as to maintain useful transfer efficiency and minimize back-transfer.

The invention has been described in detail with particular reference to certain preferred embodiments thereof, but it will be understood that variations and modifications can be effected within the spirit and scope of the invention.

The invention claimed is:

1. A module included in a plurality of tandemly arranged modules in an electrophotographic color printer, said module associated with a process control system, said module comprising:

a photoconductive image-recording member;

a charging device to establish on said photoconductive image-recording member a uniform surface potential having a voltage magnitude adjustable via said process control system;

an exposure device to modulate said uniform surface potential and thereby form a latent image on said photoconductive image-recording member;

a development station to develop said latent image and thereby form a toner image on said photoconductive image-recording member;

a transfer station for electrostatically depositing said toner image onto a receiver member in a transfer nip, said transfer station having a transfer roller and a constant-current power supply for delivering to said transfer roller a transfer current;

a controller responsive to said voltage magnitude, said controller to control said constant-current power supply so as to generate said transfer current according to a functional relationship between said transfer current and a control voltage parameter derived from said voltage magnitude;

wherein in accordance with said functional relationship said transfer current has a predetermined constant magnitude if a magnitude of said control voltage parameter is less than or equal to a critical control voltage magnitude;

wherein in accordance with said functional relationship and if said magnitude of said control voltage parameter is greater than said critical control voltage magnitude, said transfer current has a linear increase of magnitude with increase of said magnitude of said control voltage, said linear increase of said transfer current characterized by a predetermined slope; and wherein a toner control patch is produced from time to time so as to have a density substantially equal to a reference maximum density, said toner control patch derived from a patch latent image formed on said photoconductive image-recording member by said charging device and said exposure device, said patch latent image developed by said development station, said photoconductive image-recording member having been charged to said voltage magnitude prior to creating said patch latent image thereon.

2. Module of claim 1, wherein for said magnitude of said control voltage parameter greater than said critical control voltage magnitude, said transfer current has a lowest practical value so as to maintain a useful transfer efficiency and minimize back-transfer.

3. Module of claim 1, wherein said magnitude of said control voltage parameter is said voltage magnitude.

4. Module of claim 1, wherein said magnitude of said control voltage parameter is said voltage magnitude minus an offset potential magnitude minus a maximum exposure potential magnitude.

5. Module of claim 1, wherein said toner image is transferred from said photoconductive image-recording member to an intermediate transfer member and thereafter deposited in said transfer station onto said receiver member, said receiver member adhered to a transport web moved through a transfer nip in said transfer station, said transfer nip formed between said intermediate transfer member and said transfer roller.

6. Module of claim 1, wherein:

prior to said receiver member entering said transfer nip, said receiver member has moved through at least two of said modules included in said plurality of tandemly arranged modules; and at least two toner images have been transferred to said receiver member in said at least two of said modules.

7. Module of claim 1, wherein:

S is speed of said receiver member through said transfer station;

L is length of said transfer nip in said transfer station;

$I_T$ is any transfer current determined according to said functional relationship from said control voltage for said speed and for said length;

said predetermined constant magnitude of said transfer current is experimentally determined in said module for said magnitude of said control voltage parameter less than or equal to said critical control voltage magnitude;

said critical control voltage magnitude is experimentally determined in said module;

said predetermined slope is experimentally determined in said module for said magnitude of said control voltage parameter greater than said critical control voltage magnitude;

said module can be adapted for any speed S' and for any length L'; and for said any speed S' and for said any length L', said any transfer current is scaled to a modified transfer current $I_T'$, where $I_T'$ is given by the expression $I_T'=(I_T)(S'/S)(L'/L)$.

8. Module of claim 1, wherein said power supply is addressed so as to provide an increased transfer current greater than said tranfer current generated according to said functional relationship, said increased transfer current provided if said toner image exhibits a certain banding artifact.

9. Method of transferring a toner image to a receiver member in a transfer station, said transfer station included in a module of an electrophotographic printer, said receiver member moved through a plurality of modules tandemly arranged in said electrophotographic printer such that toner images can be successively transferred to said receiver member so as to make an output print, said output print included in a run of prints, said module further including a photoconductive image-recording member, a charging device, an exposure device, and a development station, said module associated with a process control system and a controller, said transfer station inclusive of a transfer roller and a constant-current power supply for delivering to said transfer roller a transfer current established via said controller, said method including the steps of:

establishing on said photoconductive image-recording member, via said charging device, a uniform surface potential having a voltage magnitude adjustable via said process control system;

modulating with said exposure device said uniform surface potential and thereby forming a latent image on said photoconductive image-recording member;

developing, in said development station, said latent image produced by said modulating and thereby forming said toner image on said photoconductive image-recording member;

moving a receiver member through said transfer station;

electrostatically transferring said toner image to said receiver member in said transfer station, said transfer current being controlled by said controller according to a functional relationship between said transfer current and a control voltage parameter derived from said voltage magnitude;

wherein, in the step of electrostatically transferring said toner image to said receiver member according to said functional relationship, if magnitude of said control voltage parameter is less than or equal to a critical control voltage magnitude said transfer current has a predetermined constant magnitude, and if said magnitude of said control voltage parameter is greater than said critical control voltage magnitude said transfer current has a linear increase of magnitude with increase of said magnitude of said control voltage parameter, said linear increase characterized by a predetermined slope; and wherein a toner control patch is made from time to time such that said toner control patch has a measured optical density substantially equal to a reference maximum density, said toner control patch derived from a patch latent image formed on said photoconductive image-recording member by said charging device and said exposure device, said photoconductive image-recording member having been charged by said charging device to said voltage magnitude prior to creating said patch latent image on said photoconductive image-recording member, said patch latent image developed by said development station, said measured optical density substantially equal to said reference maximum density being obtained by causing said process control system to control operating parameters for at least one of said charging device, said exposure device, and said development station.

10. Method of claim 9 wherein, in said step of electrostatically transferring said toner image to said receiver member in said transfer station with magnitude of said control voltage parameter being greater than said critical control voltage magnitude, said transfer current has a lowest practical value so as to maintain a useful transfer efficiency and minimize back-transfer.

11. Method of claim 9, wherein if after said step of electrostatically transferring said toner image to said receiver member said output print exhibits a banding artifact associated with said toner image, said step of electrostatically transferring said toner image is modified such that for subsequent prints included in said run of prints, an additional transfer current is added to said transfer current as would otherwise be determined from said magnitude of said control voltage parameter according to said functional relationship.

* * * * *